United States Patent [19]

Zuber et al.

[11] Patent Number: 4,562,543

[45] Date of Patent: Dec. 31, 1985

[54] VEHICLE SPEED CONTROL APPARATUS AND METHOD

[75] Inventors: Pierre A. Zuber, Baldwin, Pa.; Mario Rogers, Larkspur, Calif.

[73] Assignee: Westinghouse Electric Corp., Pittsburgh, Pa.

[21] Appl. No.: 491,480

[22] Filed: May 4, 1983

[51] Int. Cl.[3] ..... B61L 3/18

[52] U.S. Cl. ..... 364/426; 246/182 R; 246/182 B; 246/182 C; 364/436

[58] Field of Search ..... 364/424, 426, 436, 565; 324/160, 161; 246/182 B, 182 C, 182 R, 187 B

[56] References Cited

U.S. PATENT DOCUMENTS

| | | | |
|---|---|---|---|
| 3,934,125 | 9/1973 | Macano | 246/182 B |
| 4,002,314 | 7/1975 | Barpal | 246/63 C |
| 4,005,837 | 2/1977 | Grundy | 364/426 |
| 4,017,044 | 4/1977 | Anderson et al. | 246/182 C |
| 4,066,230 | 1/1975 | Nohmi et al. | 246/182 B |
| 4,103,851 | 8/1978 | Salmon | 246/63 C |
| 4,123,023 | 10/1978 | Nelson | 246/182 B |
| 4,190,220 | 2/1980 | Hahn et al. | 246/182 B |
| 4,208,717 | 6/1980 | Rush | 364/426 |
| 4,209,828 | 6/1980 | Anderson et al. | 364/426 |
| 4,217,643 | 8/1980 | Anderson et al. | 364/426 |
| 4,235,402 | 11/1980 | Matty et al. | 364/426 |
| 4,235,403 | 4/1979 | Gillen et al. | 246/182 A |
| 4,270,716 | 6/1981 | Anderson | 364/426 |
| 4,302,811 | 11/1981 | McElhenny | 364/426 |
| 4,374,422 | 2/1983 | O'Keefe, Jr. et al. | 364/426 |

*Primary Examiner*—Errol A. Krass
*Assistant Examiner*—Thomas G. Black
*Attorney, Agent, or Firm*—R. G. Brodahl

[57] ABSTRACT

A speed control system for a passenger vehicle provides a predetermined brake mode operation to control the vehicle speed when the vehicle speed plus a determined speed offset responsive to a calculated effort request signal is equal to or greater than a desired program stop speed, and then compares the calculated effort request signal with a predetermined value of the effort request signal to control the vehicle speed in response to the calculated effort request signal.

11 Claims, 11 Drawing Figures

VEHICLE SPEED CONTROL APPARATUS AND METHOD

BACKGROUND OF THE INVENTION

It is known to control with a programmed microprocessor the speed of a passenger vehicle such as a mass transit vehicle while that vehicle is moving along a roadway track, such as disclosed in U.S. Pat. No. 4,217,643. It is known to provide a smooth and comfortable stopping of such vehicle in relation to passenger stations in accordance with a predetermined or program stop velocity profile such as disclosed in U.S. Pat. Nos. 3,519,805; 3,727,406 and 4,208,717. For this purpose it is known to provide a transposed signal cable, or portions of such cable, along the vehicle travel path before a passenger station and operative with antennas carried by the vehicle to determine the travel distance and speed of the vehicle in relation to the desired stop position in the station.

SUMMARY OF THE INVENTION

In the programmed microprocessor speed control of a passenger vehicle in relation to a desired speed profile for stopping the vehicle in a passenger station, a speed offset is established as a predetermined function of the vehicle acceleration for each cyclic operation of the microprocessor until the sum of the vehicle speed and the speed offset is greater than the desired stopping speed profile. At that time the brake mode of the vehicle is initiated, with a predetermined effort control signal controlling the braking operation until the calculated effort request signal equals or is below that predetermined value, and the calculated signal then resumes control of the vehicle speed in accordance with the desired program stop velocity profile.

DESCRIPTION OF A PREFERRED EMBODIMENT

It is known for a passenger vehicle moving along a roadway track, as it approaches a passenger station, to receive position marker signals from one or more transposed cable or tape sections included in the travel path of the vehicle. The microprocessor speed control apparatus carried by the vehicle includes a memory that contains a desired stopping speed profile in the form of a look-up table. The position distance of the vehicle in relation to that speed profile is established by counting cross-over points on the cable at known separation distances such as every six inches. The marker signals from the transposed cable initiate the program stop operation as well as keep track of the vehicle position to control the vehicle in a desired slowdown speed pattern or profile.

Figure 1:
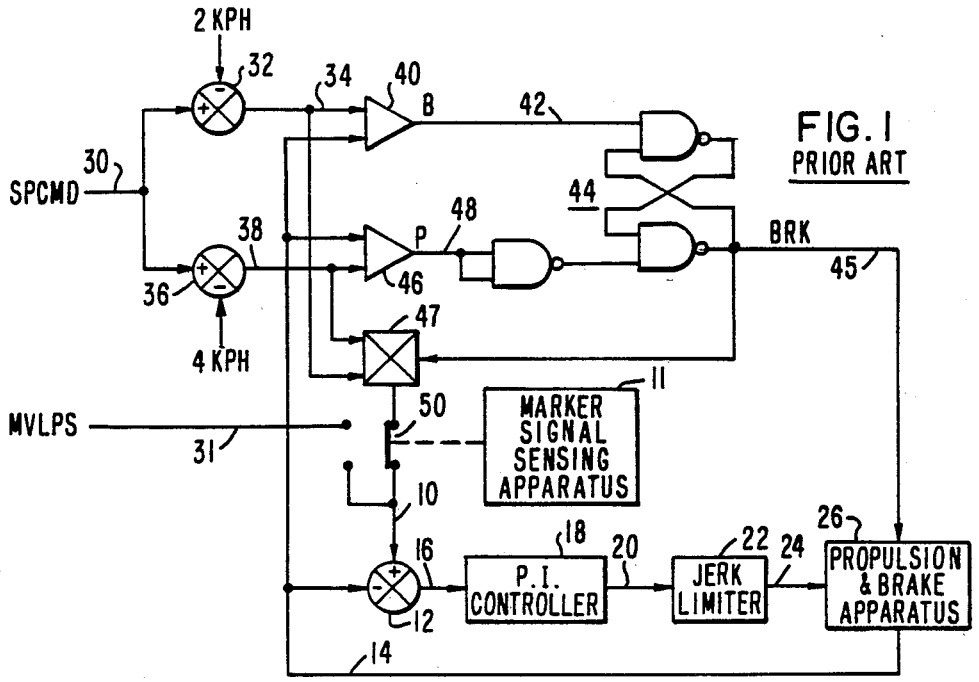
FIG. 1 PRIOR ART
FIG. 1 functionally shows a prior art vehicle speed control apparatus.

The prior art vehicle speed control apparatus shown in FIG. 1 can provide a speed maintaining operation of a passenger vehicle. The input velocity reference signal 10 to the comparator 12 can be a function of the signal block speed command (SPCMD) signal 30 when in speed maintaining control operation or a function of the marker velocity program stop signal 31 for program stop control operation. The marker signal sensing apparatus 11 responds to the transposed program stop cable positioned in the roadway of the passenger vehicle and ahead of a passenger station where it is desired that the vehicle make a stop. The marker signal sensing apparatus 11 can control the operation of a switch 50, which is in the upper position as shown in FIG. 1 when there is no marker tape provided and it is desired that the vehicle operate in the speed maintaining mode for responding to the speed command signal 30 from the signal block occupied by the vehicle. The speed command signal 30 is applied to two differencing devices 32 and 36, with the device 32 providing an input brake velocity reference 34 which is 2 KPH below the value of the speed command signal 30 and the difference device 36 providing a power velocity reference 38 which is 4 KPH below the value of the speed command signal 30. In this way when the vehicle actual speed 14 goes above the brake reference velocity 34, the comparator 40 will provide an output 42 to the power and brake controller 44, which causes the output 45 to provide a brake control signal to the propulsion and brake apparatus 26 and causes the vehicle actual speed 14 to reduce below the brake reference velocity 34. During the brake operation time, the propulsion and brake apparatus responds to the P signal or acceleration effort request signal 24 for determining the brake operation of the vehicle in the brake mode. As the actual speed of the vehicle 14 drops below the power reference velocity 38, the comparator 46 provides an output 48 to the power and brake controller 44 for causing the output 45 to initiate the power mode of operation for the propulsion and brake apparatus 26, such that the propulsion and brake apparatus 26 then responds to the P signal 24 in the power mode of operation. In addition, a selector device 47 responds to the output 45 providing either one of a brake mode of operation to apply the brake reference velocity 34 through the switch 52 to the comparator 12 or a power mode of operation to apply the power reference velocity 38 to the comparator 12 for comparison with the actual speed 14 of the vehicle to provide a speed error 16 which operates with a PI controller 18 to provide a first P signal 20, which is jerk limited in a jerk limiter 22 to provide a control P signal 24 to the propulsion and brake apparatus 26.

Figure 2:
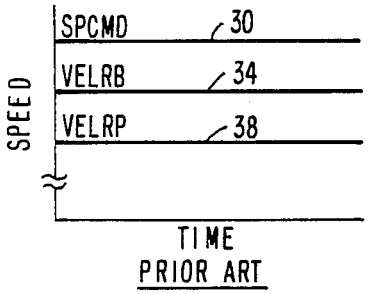
PRIOR ART FIG. 2
FIG. 2 shows the well-known speed maintaining operation provided by the speed control apparatus of FIG. 1.

In FIG. 2 there is shown the well-known relationship of the input speed command signal 30 with the brake reference velocity 34 and the power reference velocity 38 for determining the speed maintaining operation of a passenger vehicle.

Figure 3:
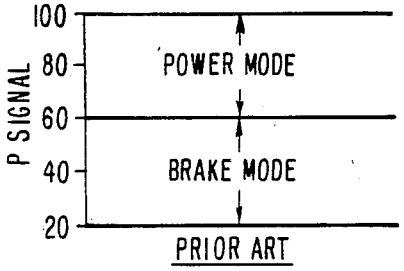
PRIOR ART FIG. 3
FIG. 3 shows the well-known relationship of the P effort request signal for each of a power mode operation and a brake mode operation.

In FIG. 3 there is shown the well-known magnitude ranges of the P signal in relation to each of the power mode and the brake mode of operation of the speed control apparatus shown in FIG. 1. When the P signal is 100 milliamps at the top of the power mode range, this provides full acceleration of the vehicle and when the P signal is at 20 milliamps at the bottom of the brake mode range, this provides the full service brake operating condition. When the P signal is at 60 milliamps, this provides the coast operation of the vehicle.

Figure 4:
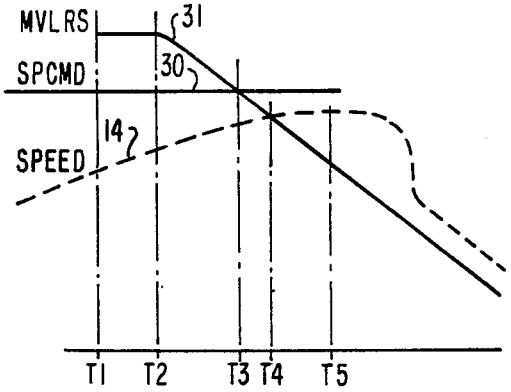
FIG. 4 PRIOR ART
FIG. 4 shows a marker velocity or program stop speed profile and the prior art vehicle speed control operation in response to that speed profile.

In FIG. 4 there is illustrated the input command speed 30, and the controlled actual vehicle speed 14 having a speed maintained difference such as 2 KPH below the command speed 30. The command speed 30 determines the vehicle operation before time T1, when the marker signal is sensed from the program stop cable positioned along the roadway track ahead of the passenger station to result in the input reference 10 to the comparator 12 becoming the marker velocity reference signal MVLPS, as illustrated by curve 31. At time T2 the marker program stop velocity profile reference 31 begins to decrease along a predetermined decreasing speed profile in accordance with the desired vehicle stopping operation, such as in relation to a passenger station. The switch 50 shown in FIG. 1 responds to the command speed signal 30 for as long as the marker velocity reference 31 is above the command speed 30, such that the vehicle speed 14 continues more or less unchanged until time T3 when the marker velocity reference 31 goes below the speed command 30 and the marker velocity reference 31 becomes the input velocity reference 10 to the comparator 12 as shown in FIG. 1. The vehicle actual speed 14 then approaches the desired program stop profile speed 31 until at time T4 the actual speed 14 goes overspeed beyond the profile speed 31 and a brake mode operation with maximum service brake condition is provided. This reduces the actual speed 14 and tends to cause the actual speed 14 to go underspeed below the profile speed 31 about time T5 when the power mode operation is again provided to bring the actual speed 14 to within a desired difference of about 2 KPH in relation to the profile speed 31. The speed control apparatus continues to control the vehicle speed 14 substantially to follow the profile speed 31 by switching between the brake mode and the power mode as required.

Figure 5:
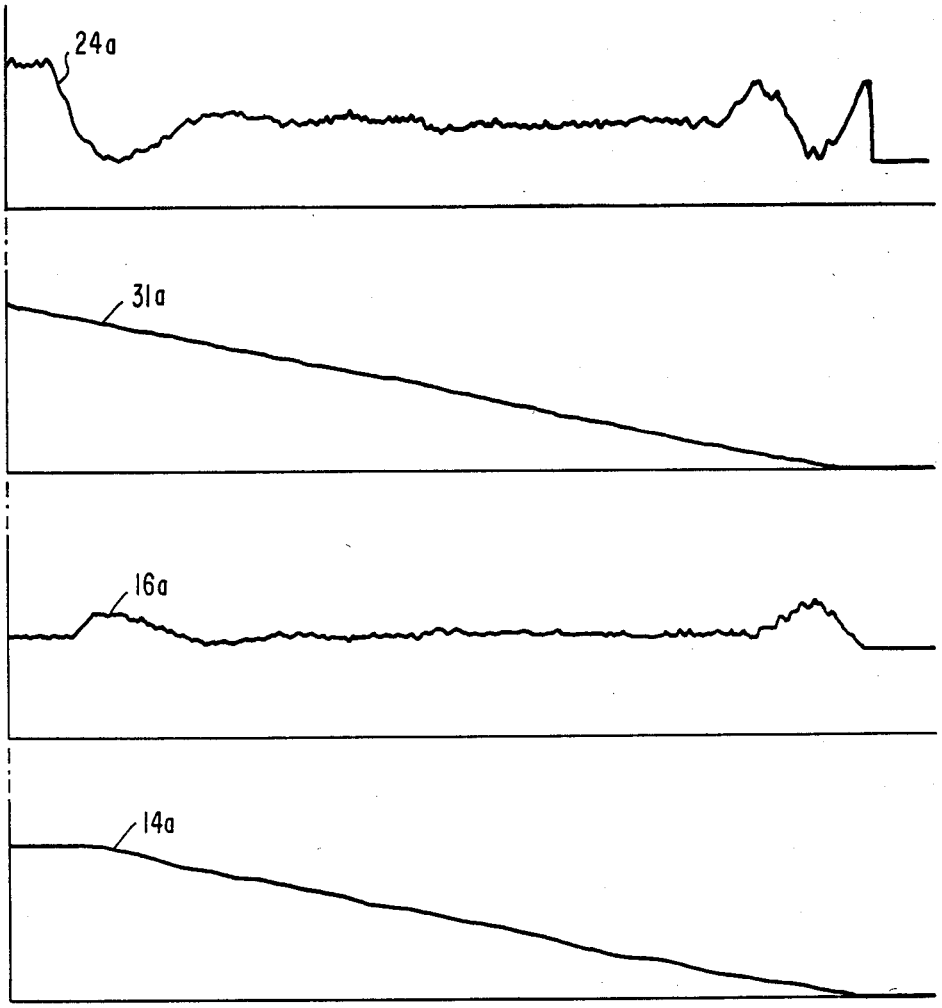
PRIOR ART FIG. 5
FIG. 5 shows the relationship between the effort request P signal, the speed error and the actual speed of the vehicle operative with the prior art speed control apparatus in response to the marker velocity reference signal.

In FIG. 5 the marker velocity program stop reference 31*a* is shown in relation to the P signal 24*a*, the speed error 16*a* and the vehicle speed 14*a* illustrate the typical program stop speed control operation provided by the speed control apparatus shown in FIG. 1.

Figure 6:
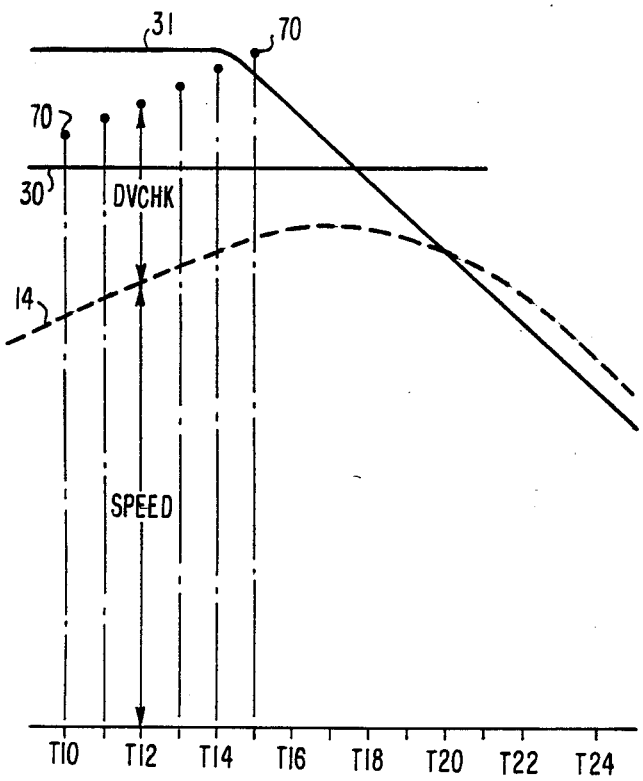
FIG. 6 shows the determination of a control speed offset to improve the flare-in or blending of the vehicle actual speed in relation to the desired program stopping profile speed provided by the speed control apparatus of FIG. 7.

In FIG. 6 there is shown the determination of a control speed offset DVCHK to enable a smooth flare-in of the actual speed 14 in relation to the desired profile speed 31 in accordance with the present invention. At time T10 assume the vehicle speed 14 is below the command speed 30 and accelerating, but since a program stop marker input signal 31 is sensed at this time, the offset speed DVCHK is calculated in accordance with the relationship $$\text{DVCHK} = \tfrac{1}{8}\,(\text{P signal} - 68) + 2\ \text{KPH} \qquad (1)$$

to provide a speed bias 70 in accordance with the relationship $$\text{speed bias} = \text{speed} + \text{DVCHK} \qquad (2)$$

Then this speed bias 70 is compared with the marker velocity reference profile signal 31 to determine the vehicle operation as follows:

$$\text{When speed bias} < \text{MVLPS, stay in the power mode} \qquad (3)$$

$$\text{When speed bias} \leqq \text{MVLPS, go to brake mode} \qquad (4)$$

Once the speed bias 70, which is the sum of the vehicle speed 14 plus the offset speed DVCHK, goes above the program stop velocity stop profile 31, in accordance with equation (4) the operation changes from power mode to the brake mode of operation and the P signal is set at no more than a maximum predetermined value of 50 milliamps, which operates to close the brake pads and begin to reduce the acceleration of the vehicle, but not provide a substantial amount of braking. This operation in the brake mode then continues until the vehicle speed 14 is greater than the marker velocity signal 31, at which time the calculated P signal again assumes control of the vehicle.

Figure 7:
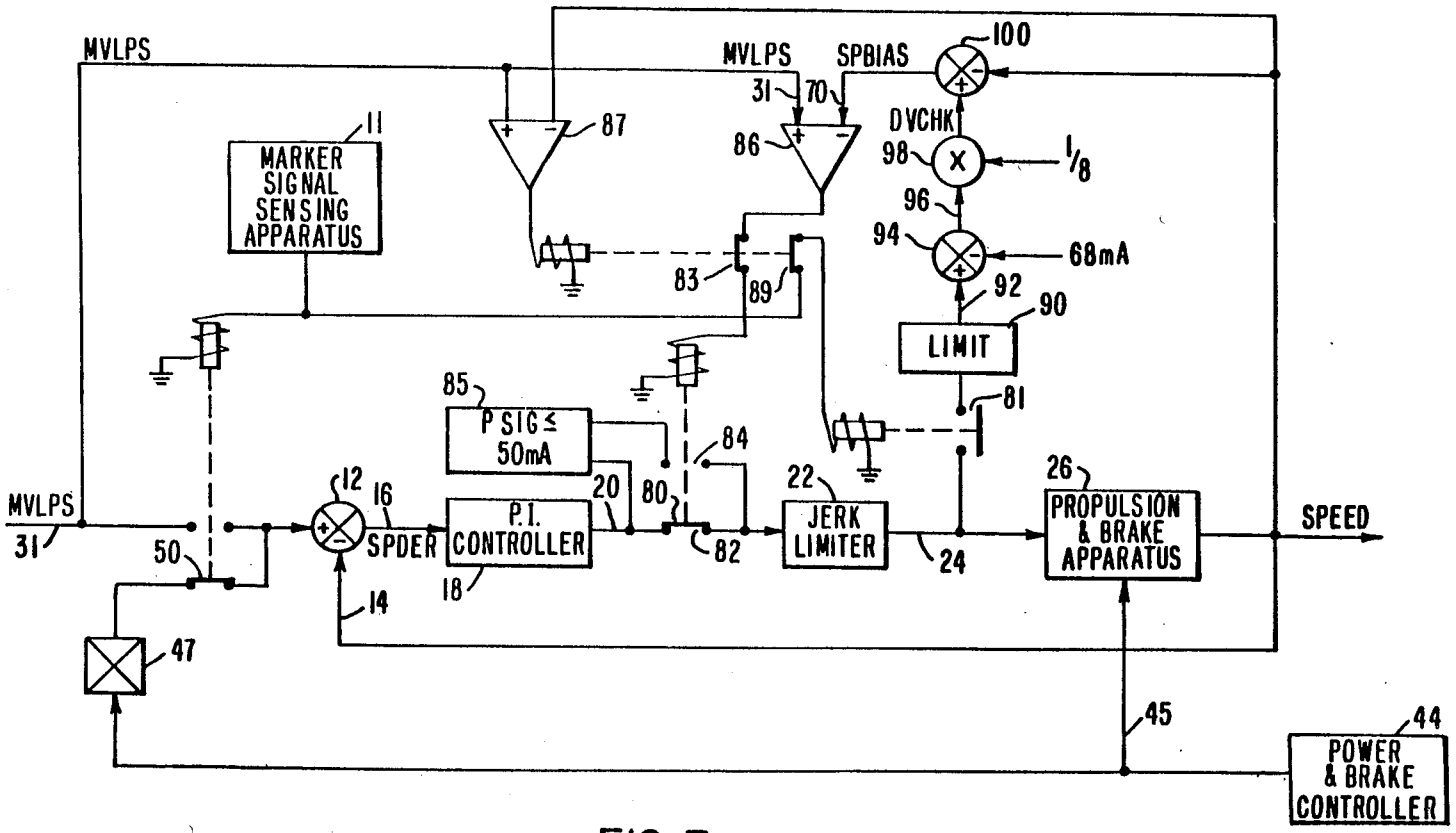
FIG. 7 functionally shows the speed control apparatus in accordance with the present invention.

In FIG. 7 there is functionally shown an illustrative speed control apparatus operative in accordance with the present invention. The operation of the power and brake controller 44 and the selector device 47 and the other components shown in FIG. 1 is the same as previously described in relation to FIG. 1. In the power mode of operation prior to the sensing of the marker velocity signal 31 by the marker velocity sensing apparatus 11, the switch 80 is operative with the terminal 82 such that the calculated P signal 20 as determined by the PI controller 18 is applied through the jerk limiter 22 to the propulsion and brake apparatus 26 for determining the speed 14 of the vehicle. When the marker signal sensing apparatus 11 provides an output signal in response to the marker velocity signal 31 being sensed by the vehicle, the switch 50 is raised to apply the marker velocity signal 31 to the comparator 12 as the speed reference signal and the switch 81 is closed to apply the P signal 24 to the minimum signal limit 90.

The minimum limit 90 operates such that when the P signal 24 is less than 77 milliamps, the limit 90 provides an output 92 of 77 milliamps. When the P signal 24 is greater than 77 milliamps, the actual calculated value of the P signal goes through the minimum limit 90 to the output 92. The difference device 94 subtracts 68 milliamps from the value of the P signal 92, and the multiplier 98 multiplies the difference output 96 by $\frac{1}{8}$ to provide the offset DVCHK that is shown in FIG. 6 and in accordance with above equation (1). The summing device 100 adds the offset DVCHK to the actual speed 14 to provide speed bias 70 in accordance with above equation (2). The comparator 86 senses when speed bias 70 is greater than MVLPS profile 31 and then raises the switch 80 into contact with the terminal 84 to provide the brake mode of operation for the speed control apparatus with a maximum P signal of no more than 50 milliamps.

This brake mode of operation, with a clamped maximum 50 milliamp P signal, is continued until the vehicle speed 14 is greater than the MVLPS signal 31 as sensed by comparator 87 and operative to open switch 83 to return the contact 80 to the lower position shown in FIG. 7 such that the calculated value of the P signal 20 then continues to determine the speed of the vehicle in response to the marker velocity program stop signal 31. When the switch 81 connected between the P signal 24 and the limit device 90 opens, the calculated value of the P signal no longer is applied to determine the speed offset DVCHK and which switch 81 is closed again when the MVLPS signal 31 is operative with the speed control apparatus.

Figure 8:
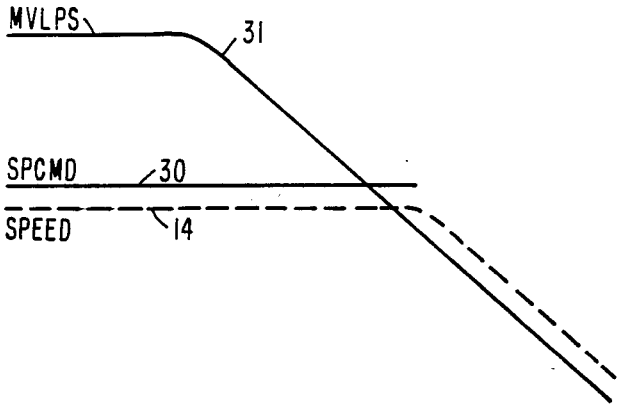
FIG. 8 shows the improved vehicle speed control provided by the apparatus of FIG. 6.

In FIG. 8 there is shown the improved speed flare-in or merge control operation provided by the speed control apparatus of FIG. 6. It is seen that the speed 14 approaches the velocity profile 31 and does not overshoot in an overspeed condition, but rather after a smooth merge with the profile 31 follows at a predetermined 2 KPH speed difference in relation to the profile 31 as desired.

Figure 9:
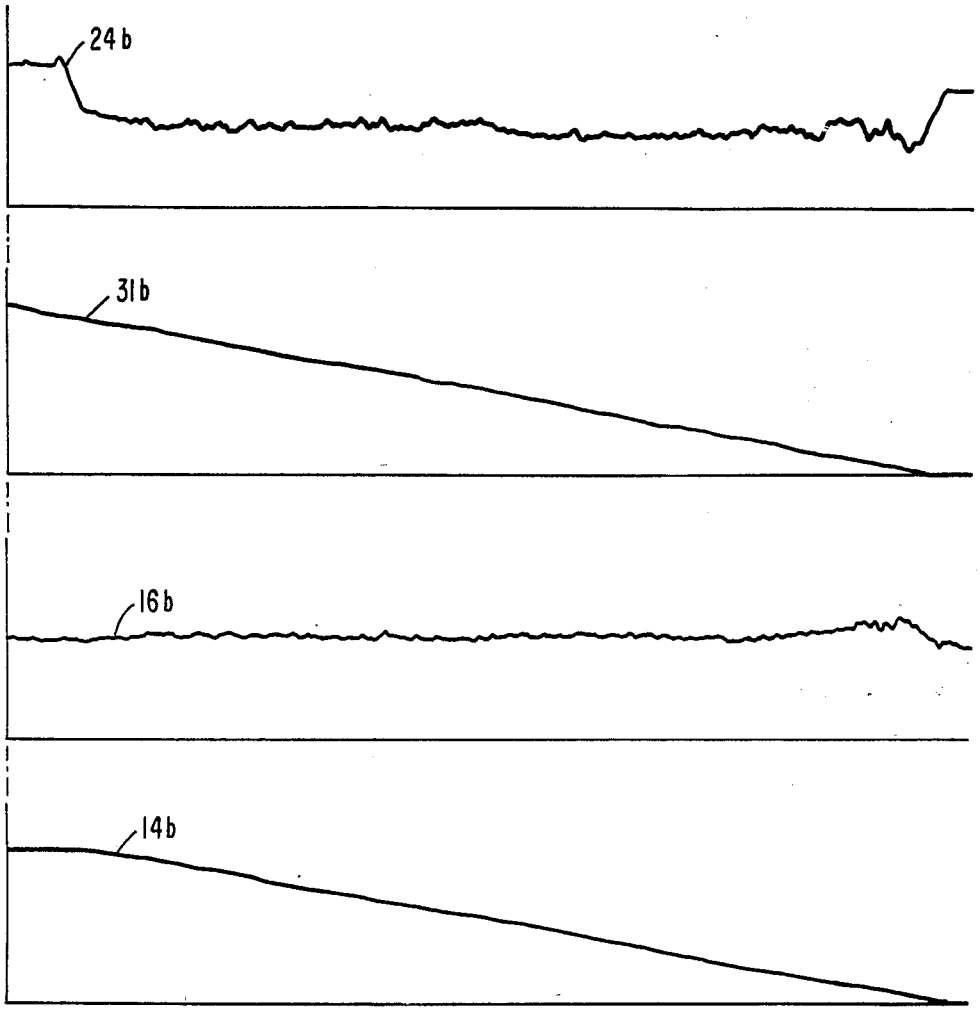
FIG. 9 shows the improved vehicle speed control of the present invention in relation to the P signal, the speed error and the actual speed of the vehicle.

In FIG. 9 the improved speed control provided by the speed control apparatus of FIG. 6 is shown, where the MVLPS reference velocity 31 is shown in **31*b*, in curve 24*b* is shown the calculated P signal 24, in curve 16*b* there is shown the speed error 16 and in curve 14*b* there is shown the actual speed 14 of the vehicle, which result with the speed control apparatus of FIG. 6**.

Figure 10:
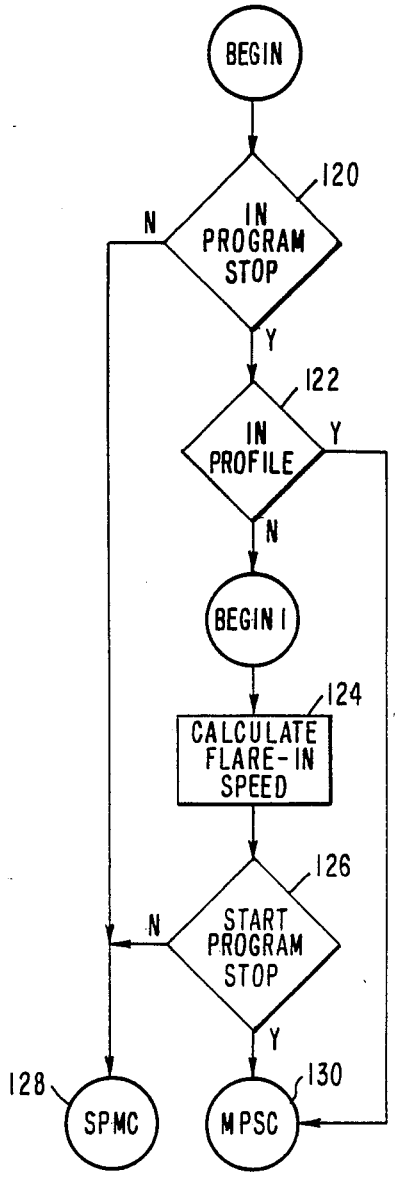
FIG. 10 shows a flow chart for the program routine determining the speed offset to control the flare-in operation with the program stop velocity profile.

In FIG. 10 there is shown the functional flow chart for the control program which establishes the speed offset DVCHK in relation to vehicle acceleration. At block 120 a check is made to see if the vehicle has responded to a roadway track marker to request the program stop operation. If not, the speed control operation goes back to a speed maintaining routine, 128, such as disclosed in U.S. Pat. No. 4,217,643. If yes, at block 122 a check is made to see if the vehicle speed is already in accordance with the desired program stop velocity profile. If it is, the operation goes to the marker program stop control routine 130, such as disclosed in U.S. Pat. No. 4,208,717. If not, the flare-in speed offset DVCHK is calculated at block 124 using above equation (1). This speed offset DVCHK responds to the vehicle acceleration through the P signal, which is an effort request signal to determine the acceleration of the vehicle, and establishes with the speed bias control parameter when to stop accelerating and start braking the vehicle in relation to that acceleration to permit the actual speed 14 to smoothly flare into the desired program stop velocity profile 31. At block 126 a check is made to see if the speed bias, which is actual speed plus the speed offset DVCHK in accordance with above equations (2), (3), and (4), is greater than the marker velocity for program stop profile 31 at that time, such that the program stop control operation should start. If not, the operation returns to the speed maintaining control routine 128 and if yes, the operation goes to the marker program stop control routine 130.

Figure 11:
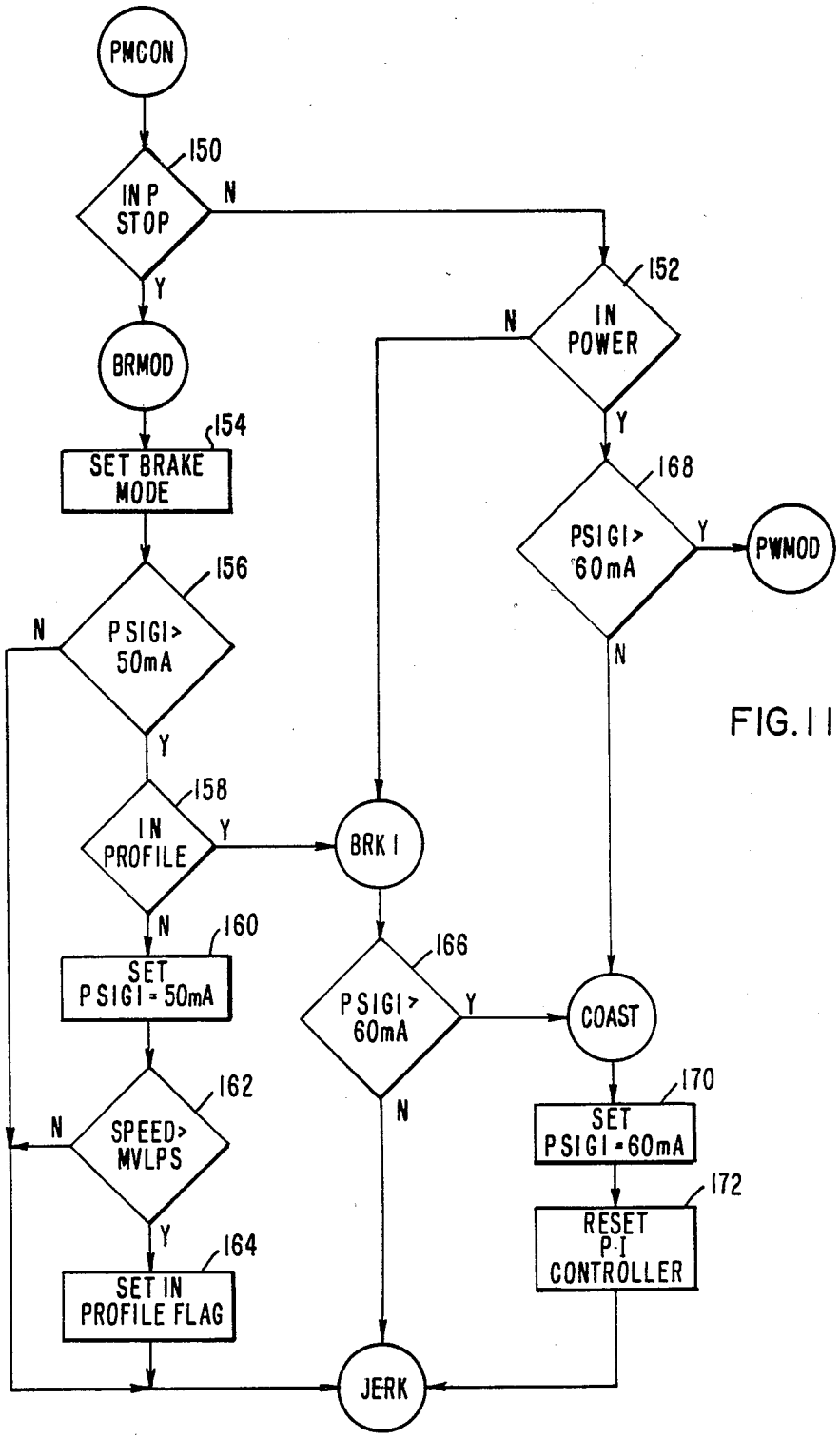
FIG. 11 shows a flow chart for the program routine determining when the actual speed plus the offset speed corresponds with the velocity profile such that the flare-in operation in response to calculated P signal is then provided.

In FIG. 11 there is shown the performance modification control routine that operates as a portion of the marker program stop control routine to determine the program stopping of the vehicle in the passenger station. At block 150 a check is made to see if the vehicle operation is in program stop. If not, the operation goes to block 152 where a check is made to see if the operation is in power. If yes at block 150, the operation goes to block 154 to set the brake mode of operation and to block 156 to check if the calculated P signal 20 is greater than 50 milliamps. If yes at block 156, then at block 158 a check is made to see if the actual speed 14 corresponds with the desired profile speed 31. If not, at step 160 the P signal 20 is clamped to a maximum of 50 milliamps, which energizes the brake pads but does not provide a substantial braking effort and which is illustrated in FIG. 6 by the operation of the switch 80 being lowered to contact the terminal 84. At block 162 a check is made to see if the speed 14 is greater than the program stop profile velocity 31 and if yes, the in profile flag is set at block 164 and the calculated P signal 20 again controls the program stop operation, which is illustrated by the comparator 87 in FIG. 6 moving the switch 80 in contact with terminal 82 and opening the switch 81.

At block 152 if the operation is not in power, the operation goes to block 166 to check if the P signal 20 is greater than 60 milliamps and if not, the operation goes to the jerk limiter routine. If yes at block 166, the operation goes to the coast routine. If yes at block 152, a check is made at block 168 to see if the P signal is greater than 60 milliamps and if not, the operation goes to the coast routine. If yes at block 168, the operation goes to determine what level of performance modification is required. At block 170 the P signal 20 is set to 60 milliamps for the coast operation and at block 172 the PI controller 18 is reset.

In Appendix A there is included an instruction program listing that has been prepared to control a process operation, such as a transit passenger vehicle in accordance with the preferred embodiment of the present invention and the flow chart shown in FIG. 10 and in Appendix B there is included an instruction program listing in accordance with the preferred embodiment of the present invention and the flow chart shown in FIG. 11. These instruction program listings are written in the assembly language of an Intel 8080 microprocessor computer system that is provided to implement the speed control apparatus of FIG. 6 for this purpose. Many of these computer systems have already been supplied to customers, including customer instruction books and descriptive documentation to explain to persons skilled in this art the operation of the hardware logic and the executive software of this digital computer system. These instruction program listings are included to provide an illustration of one suitable embodiment of the present control system and method that has actually been prepared. These instruction program listings at the present time are more or less development programs and have not been extensively debugged through the course of practical operation of vehicles on a transit system. It is well known by persons skilled in this art that real time process control application programs may contain some bugs or minor errors, and it is within the skill of such persons and takes varying periods of actual operation time to identify and correct the more critical of these bugs.

APPENDIX A

| LOC | OBJ | LINE | SOURCE STATEMENT | | | |
|---|---|---|---|---|---|---|
| | | 361 | | | | |
| 0BFA | 77 | 362 | BEGIN: | MOV | M,A | ;HOLD TIMER |
| 0BFB | 3A3274 | 363 | | LDA | MPSFL | |
| 0BFE | B7 | 364 | | ORA | A | ;DO PROGRAM STOP ? |
| 0BFF | CAB10C | 365 | | JZ | SPMC | ;NO, SET SPEED MAINTAINING CONSTANTS |
| 0C02 | 3A3374 | 366 | | LDA | MPSF1 | |
| 0C05 | B7 | 367 | | ORA | A | ;IN PROFILE ? |
| 0C06 | C2710C | 368 | | JNZ | MPSC | ;YES, SET MARKER/P-STOP CONSTANTS. |
| 0C09 | 3A1E74 | 369 | | LDA | PSIG | |
| 0C00 | FED5 | 370 | | CPI | 197 | ;PSIG > 77 MA ? |
| 0C0E | D2130C | 371 | | JNC | BE8N3 | ;YES. |
| 0011 | 3ED5 | 372 | | MVI | A,197 | ;BET PSIG = 77 MA. |
| | | 373 | | | | |
| 0C13 | B6AB | 374 | BEGN1: | SUI | 173 | ;PSIG - 68 MA. |
| 0C15 | 0F | 375 | | RRC | | |
| 0C16 | 0F | 376 | | RRC | | |
| 0C17 | E63F | 377 | | ANI | 3FH | ;BVCHK = .25(PSIG - 68). |
| 0C19 | 320974 | 378 | | STA | DVCHK | |
| 0C1C | 210474 | 379 | | LXI | H,SPEED | |
| 0C1F | B6 | 380 | | ADD | M | ;SPEED BIAS = SPEED ÷ BVCHK. |
| 0C20 | 320A74 | 381 | | STA | SBIAS | |
| 0C23 | 210174 | 382 | | LXI | H,MVLPS | |
| 0C26 | P6 | 383 | | SUP | M | ;START PROGRAM STOP ? |
| 0C27 | BAB10C | 384 | | JC | SPMC | ;NO: KEEP ON WITH SPEED MAINTAINING. |
| 0C2A | 3E0A | 385 | | MVI | A:0AH | ;SET FLARE IN FLAG. |
| 0C2C | 323374 | 386 | | STA | MPSF1 | |
| 0C2F | 210000 | 387 | | LXI | H,00H | |
| 0C32 | 221474 | 388 | | SHLD | PI | ;RESET PI CONTROLLER. |
| 0C35 | C37100 | 389 | | JMP | MPSC | ;SET MARKER/PROGRAM STOP CONSTANTS. |
| | | 390 | | | | |

APPENDIX B

| LOC | OBJ | LINE | SOURCE STATEMENT | | | |
|---|---|---|---|---|---|---|
| | | 648 | | PERFORMANCE MODIFICATION CONTROL ROUTINE. | | |
| | | 649 | | | | |
| 0DD6 | 213374 | 650 | PMCON: | LXI | H,MPSF1 | |
| 0DD9 | 117874 | 651 | | LXI | D,OUT6A | |
| 0DDC | 7E | 652 | | MOV | A,M | ;SET MPSF1. |
| 0DDD | B7 | 653 | | ORA | A | ;IN PROGRAM STOP ? |
| 0DDE | C2F00D | 654 | | JNZ | BRMOD | ;YES. |
| 0DE1 | 1A | 655 | | LDAX | D | ;GET OUT6A |
| 0DE2 | E602 | 656 | | ANI | 02H | ;IN POWER ? |
| 0DE4 | CA110E | 657 | | JZ | BRK1 | ;NO. |
| 0DE7 | 3E99 | 658 | | MVI | A:153 | |
| 0DE9 | B8 | 659 | | CMP | B | ;PSIG1 > 60 MA ? |
| 0DEA | D2170E | 660 | | JNC | COAST | ;NO. |
| 0DEB | C3210E | 661 | | JMP | PWMOD | |
| | | 662 | | | | |
| 0DF0 | FE | 663 | BRMOD: | DI | | ;VISABLE INTERRUPT. |
| 0DF1 | 1A | 664 | | LDAX | D | ;GET OUT6A |
| 0DF2 | E60B | 665 | | ANI | ODH | ;SET BRAKE MODE. |
| 0DF4 | 12 | 666 | | STAX | B | ;UP-DATE OUT6A. |
| 0DF5 | 7E | 667 | | MOV | A,M | ;SET MPSF1 FLAG8. |
| 0DE6 | 17 | 668 | | RAL | | ;IN PROFILE ? |
| 0DF7 | BA110E | 669 | | JC | BRKI | ;YES. |
| 0DFA | 3A0174 | 670 | | LDA | MVLPS | |
| 0DFB | 4F | 671 | | MOV | C,A | ;TEMP C = MVLP8. |
| 0DFE | 3A0474 | 672 | | LDA | SPEED | |
| 0E01 | B9 | 673 | | CMP | C | ;MVLPS > SPEED ? |
| 0E02 | BA070E | 674 | | JC | BRK0 | ;YES. |
| 0E05 | 36AA | 675 | | MVI | M,0AAH | ;SET IN PROFILE FLAG. |
| | | 676 | | | | |
| 0E07 | 3E7F | 677 | BRK0: | MVI | A,127 | |
| 0E09 | B8 | 678 | | CMP | B | ;PSIG1 > 50 MA ? |
| 0E0A | D26B0E | 679 | | JNC | JERK | ;NO. |
| 0E0B | 47 | 680 | | MOV | B,A | ;SET PSIG1 = 50 MA. |
| 0E0E | C36B0E | 681 | | JMP | JERK | |
| | | 682 | | | | |
| 0E11 | 3E99 | 683 | BRK1: | MVI | A,153 | |
| 0E13 | B8 | 684 | | DMP | B | ;PSIG1 > 60 MA ? |
| 0E14 | D26B0E | 685 | | JNC | JERK | ;NO. |
| | | 686 | | | | |
| 0E17 | 47 | 687 | COAST: | MOV | B,A | ;TEMP B = PSIG1 = 60 MA. |
| 0E18 | 210000 | 688 | | LXI | H,00H | ;RESET PI CONTROLLER. |
| 0E1B | 221474 | 689 | | SHLD | PI | |
| 0E1E | C36B0E | 690 | | JMP | JERK | |
| | | 691 | | | | |

We claim:

1. In speed control apparatus for a vehicle moving along a track having a speed command signal and a program stop control signal, said vehicle being operative in one of a power mode and a brake mode, the combination of means coupled with the vehicle for providing an actual speed signal, means responsive to the speed command signal and the actual speed signal for calculating an effort request signal, means responsive to the speed command signal and the actual speed signal for providing a power mode operation for a first value of the actual speed signal and a brake mode operation for a second value of the actual speed signal, means responsive to the effort request signal for providing a speed offset signal, means for comparing the program stop control signal with the sum of the actual speed signal and the speed offset signal to change from a power mode operation to a brake mode operation and to provide the effort request signal having no more than a predetermined maximum value to control said vehicle speed, and means responsive to the actual speed signal being greater than said program stop control signal for controlling the vehicle speed in response to said calculated effort request signal.

2. The speed control apparatus of claim 1, with the speed offset signal providing means being responsive to the sum of the actual speed and the speed offset signal being greater than the program stop control signal.

3. The speed control apparatus of claim 1, including means responsive to the program stop control signal for initiating the operation of speed offset signal providing means.

4. The speed control apparatus of claim 1, including means responsive to the program stop control signal being less than the sum of the actual speed and the speed offset signal for terminating the provision of the speed offset signal.

5. The speed control apparatus of claim 1, with the speed offset signal having a predetermined relationship with the effort request signal.

6. The speed control apparatus of claim 1, with the speed offset signal being determined in relation to a difference between the calculated effort request and a predetermined value of the effort request.

7. In a method for the speed control of a vehicle operative with a track having a stop control signal and a desired speed signal, the steps of:

providing an actual speed signal in accordance with the actual speed of the vehicle, determing a speed control signal in relation to the desired speed signal and the actual speed signal, providing a speed offset signal in relation to the speed control signal, providing a first speed control operation of the vehicle in response to a comparison of the stop control signal and the sum of the actual speed signal with the speed offset signal, and providing a second speed control operation of the vehicle in response to the actual speed signal being greater than the stop control signal.

8. The speed control method of claim 7, with the first speed control operation being the brake mode of said vehicle in response to the speed control signal having no more than a predetermined value.

9. The speed control method of claim 7, with the second speed control operation being the brake mode of the vehicle in response to the determined speed control signal.

10. The speed control method of claim 7, with the first speed control operation being in response to the speed control signal having no more than a predetermined maximum value and with the second speed control operation being in response to the determined speed control signal.

11. The speed control method of claim 7, with the first speed control operation being followed by the second speed control operation.

* * * * *